US011517069B2

(12) United States Patent
Minami

(10) Patent No.: US 11,517,069 B2
(45) Date of Patent: Dec. 6, 2022

(54) ARTICLE OF FOOTWEAR WITH MEDIAL CONTACT PORTION

(71) Applicant: NIKE, Inc., Beaverton, OR (US)

(72) Inventor: Tetsuya T. Minami, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 849 days.

(21) Appl. No.: 14/873,404

(22) Filed: Oct. 2, 2015

(65) Prior Publication Data

US 2016/0095380 A1 Apr. 7, 2016

Related U.S. Application Data

(63) Continuation of application No. 13/303,878, filed on Nov. 23, 2011, now Pat. No. 9,179,732.

(51) Int. Cl.

| | |
|---|---|
| ***A43B 23/02*** | (2006.01) |
| ***A43B 5/02*** | (2006.01) |
| ***A43B 23/08*** | (2006.01) |

(52) U.S. Cl.

CPC ..... *A43B 5/025* (2013.01); *A43B 23/028* (2013.01); *A43B 23/0235* (2013.01); *A43B 23/088* (2013.01)

(58) Field of Classification Search

CPC .. A43B 5/02; A43B 5/025; A43B 3/00; A43B 23/00; A43B 23/0225;

(Continued)

(56) References Cited

U.S. PATENT DOCUMENTS 3,114,982 A * 12/1963 McGowan ..... A43B 3/0031 36/132
3,191,321 A * 6/1965 Brutting ..... A43B 5/02 36/133

(Continued)

FOREIGN PATENT DOCUMENTS

CN 1416325 A 5/2003
CN 102573546 A 7/2012

(Continued)

OTHER PUBLICATIONS

English machine translation of FR 2,365,972 A1. Via espacenet.com. Translation performed on Oct. 5, 2021. (Year: 1978).*

(Continued)

*Primary Examiner* — Jameson D Collier
(74) *Attorney, Agent, or Firm* — Bookoff McAndrews, PLLC

(57) ABSTRACT

An article of footwear with a medial contact portion disposed on the medial side of the article is described. The medial contact portion includes a plurality of raised elements that extend outwards from the surface of the upper on the medial side. The raised elements are configured to contact a ball during passing or trapping to absorb and dampen forces associated with the impact of the ball with the article to provide cushioning. The sizing and spacing arrangement of the raised elements on the medial contact portion provide sufficient surface area to allow a portion of the surface of the upper to contact a ball. In one embodiment, the upper is made from a synthetic leather material that has substantially the same coefficient of friction under dry conditions and wet conditions.

20 Claims, 13 Drawing Sheets

(58) Field of Classification Search
CPC ..... A43B 23/0265; A43B 23/026; A43B 23/0215; A43B 23/0235; A43B 23/028; A43B 23/088
USPC ..... 36/45, 83, 114, 128, 132, 133, 136
See application file for complete search history.

(56) References Cited

U.S. PATENT DOCUMENTS

RE26,340 E 2/1968 Dassler
D210,864 S 4/1968 Tusa
3,525,165 A 8/1970 Randall, Jr.
3,650,051 A * 3/1972 Sass ..... A43B 5/02 36/128
4,442,615 A * 4/1984 Danks ..... A43B 5/025 36/133
4,712,317 A * 12/1987 Sowell ..... A43B 5/025 36/133
4,837,960 A 6/1989 Skaja
4,907,355 A 3/1990 Allen et al.
D332,693 S 1/1993 Chen
5,437,112 A * 8/1995 Johnston ..... A43B 5/02 36/128
D393,346 S 4/1998 Hlavacs
5,737,858 A 4/1998 Levy
5,832,636 A 11/1998 Lyden et al.
5,897,446 A * 4/1999 Wiseman ..... A43B 5/02 36/114
D431,351 S 10/2000 Prats et al.
6,457,261 B1 10/2002 Crary
D465,320 S 11/2002 Weege
6,523,282 B1 * 2/2003 Johnston ..... A43B 5/02 36/133
6,681,503 B2 * 1/2004 Morie ..... A43B 5/02 36/133
D508,308 S 8/2005 Galway
D513,849 S 1/2006 Hull
D520,723 S * 5/2006 Hoeft ..... D2/972
D522,225 S 6/2006 Holmes
D533,340 S * 12/2006 Chung ..... D2/972
7,155,846 B2 1/2007 Alfaro et al.
D540,025 S * 4/2007 Shaffer ..... D2/972
7,487,605 B2 * 2/2009 Hatzilias ..... A43B 5/02 36/128
7,562,471 B2 * 7/2009 Minami ..... A43B 3/0078 36/128
7,566,488 B2 7/2009 Mimura et al.
D602,235 S * 10/2009 Hatzilias ..... 36/133
D602,684 S * 10/2009 Henderson ..... D2/972
7,625,625 B2 12/2009 Rios et al.
D614,391 S 4/2010 Stauffer
D614,851 S 5/2010 Minami
7,941,943 B2 * 5/2011 Baker ..... A43B 5/02 36/133
8,042,289 B2 10/2011 Minami
9,179,732 B2 11/2015 Minami
2003/0167658 A1 * 9/2003 Davis ..... A43B 5/02 36/128
2004/0055183 A1 * 3/2004 Lee ..... A43B 5/02 36/128
2004/0088888 A1 5/2004 Johnston
2005/0144812 A1 7/2005 Wheeler
2005/0268497 A1 * 12/2005 Alfaro ..... A43B 1/0027 36/136
2006/0065360 A1 * 3/2006 Liu ..... A43B 23/24 156/272.8
2008/0005930 A1 1/2008 Skirrow
2008/0102245 A1 5/2008 Mimura et al.
2009/0007457 A1 1/2009 Skirrow
2009/0071041 A1 * 3/2009 Hooper ..... A43B 7/06 36/3 A
2009/0100713 A1 * 4/2009 Adami ..... A43B 3/0047 36/100
2009/0113766 A1 * 5/2009 Hooper ..... A43B 5/02 36/133
2009/0162596 A1 6/2009 Rios et al.
2009/0162651 A1 6/2009 Rios et al.
2010/0077637 A1 * 4/2010 Hatzilias ..... A43B 5/02 36/133
2010/0151133 A1 6/2010 Mimura et al.
2010/0180469 A1 * 7/2010 Baucom ..... A43B 3/0031 36/100
2010/0183814 A1 7/2010 Rios et al.
2010/0275463 A1 * 11/2010 Gallagher ..... A43B 5/02 36/133
2010/0299961 A1 * 12/2010 Baker ..... A43B 5/02 36/94
2010/0299967 A1 * 12/2010 Atsumi ..... A43B 5/02 36/133
2010/0331122 A1 * 12/2010 Morag ..... A43B 5/025 473/422
2011/0179676 A1 7/2011 Baker et al.
2011/0239485 A1 10/2011 Hooper et al.
2011/0247240 A1 * 10/2011 Eder ..... A43B 1/0009 36/133
2011/0258883 A1 * 10/2011 Eder ..... A43B 5/02 36/133

FOREIGN PATENT DOCUMENTS

DE 2743666 A1 3/1978
DE 2652055 A1 5/1978
DE 3314274 A1 10/1983
EP 2782467 A1 10/2014
FR 2365972 A1 4/1978
GB 2259639 A 3/1993
JP 4414478 B1 2/2010
WO 2008038041 A1 4/2008
WO 2010055276 A1 5/2010

OTHER PUBLICATIONS

International Preliminary Report on Patentability (including Written Opinion of the ISA) dated Jun. 5, 2014 in International Application No. PCT/US2012/062641.
International Search Report and Written Opinion for Application No. PCT/US2012/062641, dated Mar. 1, 2013.
Office Action dated Jul. 9, 2015 for Chinese Application No. 201280057142.0.
European Patent Office, Communication pursuant to Article 94(3) EPC for EP Application No. 12798466.4, dated Jan. 9, 2017.
State Intellectual Property Office (PRC), Office Action for CN Application No. 201610597248.X, dated Nov. 7, 2017.

* cited by examiner

ARTICLE OF FOOTWEAR WITH MEDIAL CONTACT PORTION

CROSS-REFERENCE TO RELATED APPLICATION

This application is a continuation of co-pending U.S. patent application Ser. No. 13/303,878 filed on Nov. 23, 2011 and entitled "Article of Footwear With Medial Contact Portion", the disclosure of which application is hereby incorporated by reference in its entirety.

BACKGROUND

The present invention relates generally to an article of footwear, and in particular to an article of footwear with a medial contact portion for contacting a ball.

Articles of footwear have been provided with various provisions for contacting a ball. U.S. Patent Application Publication No. 2003/0167658 to Davis discloses a ball controlling surface on a toe portion of a shoe that includes a plurality of grooved rubber elements to provide friction. U.S. Patent Application Publication No. 2004/0055183 to Lee et al. discloses a soccer shoe that includes a plurality of protrusions along an inner and outer side of the toe portion of the shoe.

Therefore, there exists a need in the art for an article of footwear that includes provisions for contacting a ball along a medial side of the article. There also exists a need in the art for an article of footwear with provisions for contacting a ball that is configured to be flexible and lightweight.

SUMMARY

In one aspect, the invention provides an article of footwear, comprising: an upper and a sole structure; the upper including a medial contact portion disposed along a medial side of the upper and extending through at least a midfoot region of the article of footwear; the medial contact portion including a plurality of raised elements disposed on the upper, the plurality of raised elements extending outward from a surface of the upper; wherein each of the plurality of raised elements is associated with a length aligned generally along a vertical direction of the upper and a width aligned generally along a longitudinal direction of the upper; wherein the length of each raised element is less than a height of the upper; and wherein the plurality of raised elements are spaced apart from each other along the upper by a distance greater than the width of each raised element.

In another aspect, the invention provides an article of footwear, comprising: an upper and a sole structure; the upper comprising a medial contact portion disposed on a medial side of the upper extending through at least a midfoot region of the article of footwear; the medial contact portion including at least one group of raised elements disposed on the upper, each raised element extending outward from a surface of the upper; wherein each raised element has length associated with a major axis aligned generally along a vertical direction of the upper and a width associated with a minor axis aligned generally along a longitudinal direction of the upper; and wherein each raised element is disposed on the surface of the upper at the widest lateral portion of the upper.

In another aspect, the invention provides an article of footwear, comprising: an upper and a sole structure; the sole structure including a rigid heel cup disposed in a heel region of the article of footwear; the upper comprising a medial contact portion disposed generally in a midfoot region of the article of footwear; the medial contact portion including a plurality of raised elements disposed on the upper, each raised element extending outward from a surface of the upper; wherein each of the raised elements has a substantially flat distal surface and includes a plurality of fins arranged in a generally horizontal direction; wherein a first portion of the raised elements are configured to be flexible so as to bend with the upper; and wherein a second portion of the raised elements is configured to be disposed on the upper at a location above the rigid heel cup so as to resist bending with the upper.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
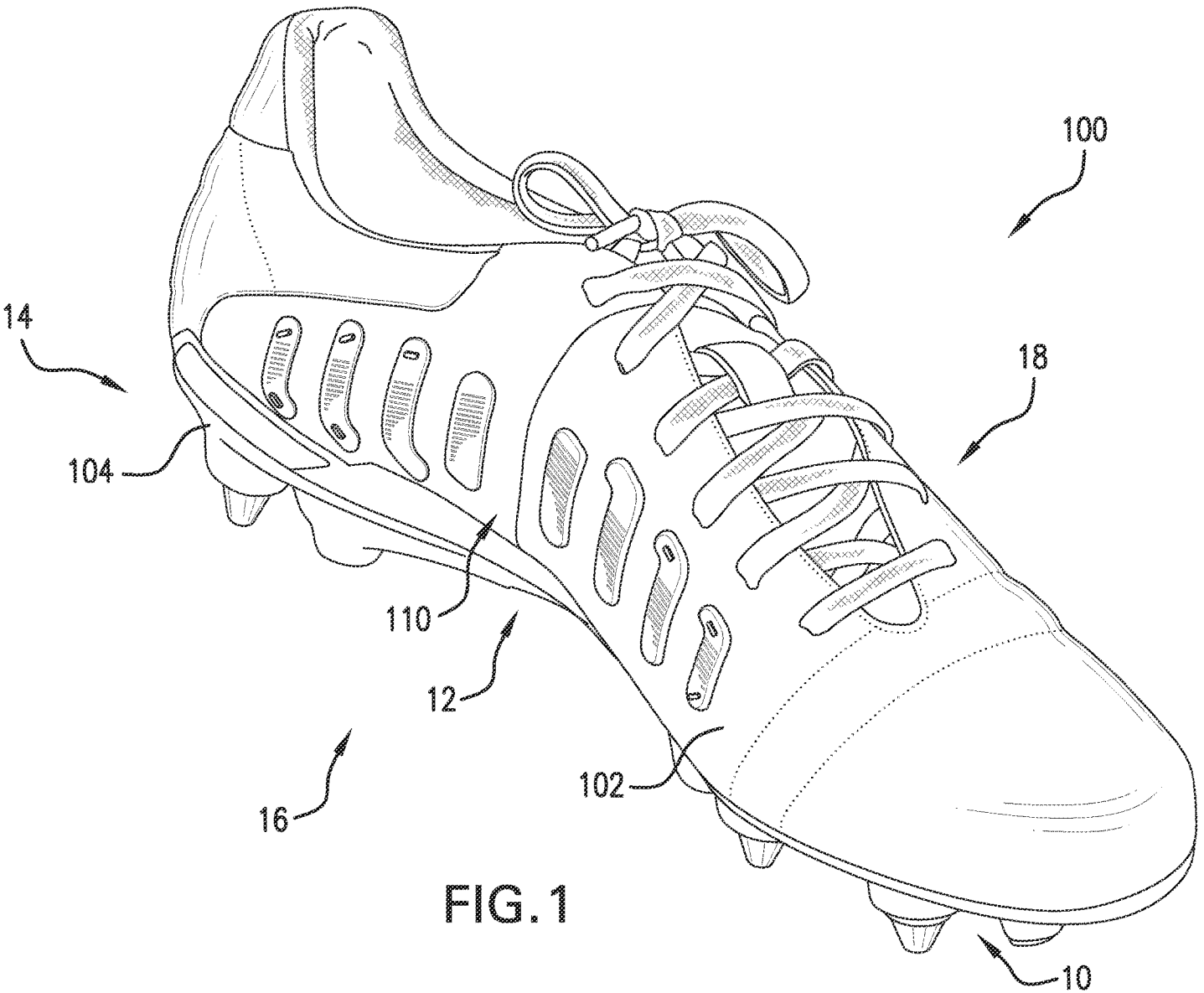
FIG. 1 is an isometric view of an embodiment of an article of footwear including a medial contact portion.

FIGS. 1 through 13 illustrate an exemplary embodiment of article of footwear 100. For clarity, the following detailed description discusses an exemplary embodiment, in the form of a sports shoe, and, in particular, a soccer shoe, but it should be noted that the present invention could take the form of any article of footwear including, but not limited to: soccer shoes, football shoes, sneakers, rugby shoes, basketball shoes, baseball shoes, hiking boots, as well as other kinds of shoes. As shown in FIGS. 1 through 13, article of footwear 100, also referred to simply as article 100, is intended to be used with a left foot; however, it should be understood that the following discussion may equally apply to a mirror image of article of footwear 100 that is intended for use with a right foot.

Referring to FIGS. 1 through 13, for purposes of reference, article 100 may include forefoot region 10, midfoot region 12 and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, article 100 may include medial side 16 and lateral side 18. In particular, medial side 16 and lateral side 18 may be opposing sides of article 100. Furthermore, both medial side 16 and lateral side 18 may extend through forefoot region 10, midfoot region 12 and heel region 14.

It will be understood that forefoot region 10, midfoot region 12 and heel region 14 are only intended for purposes of description and are not intended to demarcate precise regions of article 100, but rather, to describe relative positions. Likewise, medial side 16 and lateral side 18 are intended to represent generally two sides of an article, rather than precisely demarcating article 100 into two halves. In addition, forefoot region 10, midfoot region 12 and heel region 14, as well as medial side 16 and lateral side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot region to a heel region of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

Referring now to FIG. 1, an isometric view of an embodiment of an article of footwear 100 including a medial contact portion is illustrated. Article 100 may include an upper 102 and sole structure 104. Generally, upper 102 may be any type of upper. In particular, upper 102 may have any design, shape, size and/or color. For example, in embodiments where article 100 is a soccer shoe, upper 102 could be a low top upper. In embodiments where article 100 is a basketball shoe, upper 102 could be a high top upper that is shaped to provide high support on an ankle. Generally, upper 102 may be made from any suitable material, including a material that includes, but is not limited to, nylon, natural leather, synthetic leather, natural rubber, or synthetic rubber. In some cases, upper 102 can be made of any suitable knitted, woven or non-woven material.

In an exemplary embodiment, upper 102 may be made of a synthetic leather material that is configured to have substantially the same coefficient of friction under dry conditions and wet conditions. Synthetic leather materials configured to have substantially the same coefficient of friction under dry conditions and wet conditions may include any one or more of the materials and/or processes disclosed in U.S. Pat. No. 7,625,625 to Rios et al., U.S. Pat. No. 7,566,488 to Mimura et al., U.S. Patent Application Publication No. 2010/0183814 to Rios et al., U.S. Patent Application Publication No. 2010/0151133 to Mimura et al., U.S. Patent Application Publication No. 2009/0162651 to Rios et al., U.S. Patent Application Publication No. 2009/0162596 to Rios et al., U.S. Patent Application Publication No. 2009/0007457 to Skirrow, U.S. Patent Application Publication No. 2008/0102245 to Mimura et al., and U.S. Patent Application Publication No. 2008/0005930 to Skirrow, the disclosure of each is hereby incorporated by reference in its entirety.

In some embodiments, sole structure 104 may be configured to provide traction for article 100. In addition to providing traction, sole structure 104 may attenuate ground reaction forces when compressed between the foot and the ground during walking, running or other ambulatory activities. The configuration of sole structure 104 may vary significantly in different embodiments to include a variety of conventional or non-conventional structures. In some cases, the configuration of sole structure 104 may be configured according to one or more types of ground surfaces on which sole structure 104 may be used. Examples of ground surfaces include, but are not limited to: natural turf, synthetic turf, dirt, as well as other surfaces.

Sole structure 104 is secured to upper 102 and extends between the foot and the ground when article 100 is worn. In different embodiments, sole structure 104 may include different components. For example, sole structure 104 may include an outsole, a midsole, and/or an insole. In some cases, one or more of these components may be optional. Sole structure 104 may be made from any suitable material, including a material that includes, but is not limited to, elastomers, siloxanes, natural rubber, other synthetic rubbers, aluminum, steel, natural leather, synthetic leather, or plastics.

In some embodiments, sole structure 104 may be provided with one or more types of traction elements on a bottom surface of sole structure 104. The term "traction elements" as used in this detailed description and throughout the claims includes any provisions disposed on a sole structure for increasing traction through friction or penetration of a ground surface, including, but not limited to cleats, studs, projections, or treads. Typically, traction elements may be configured for football, soccer, baseball or any type of activity that requires traction with a ground surface.

Article of footwear 100 may include one or more provisions for contacting a ball using a portion of article 100. In one embodiment, article 100 may include a medial contact portion 110. Medial contact portion 110 is disposed along medial side 16 of article 100. In one embodiment, medial contact portion 110 may be configured to correspond to an instep of a foot of a wearer of article 100. In some embodiments, medial contact portion 110 may be provided to make contact with a ball.

Figure 2:
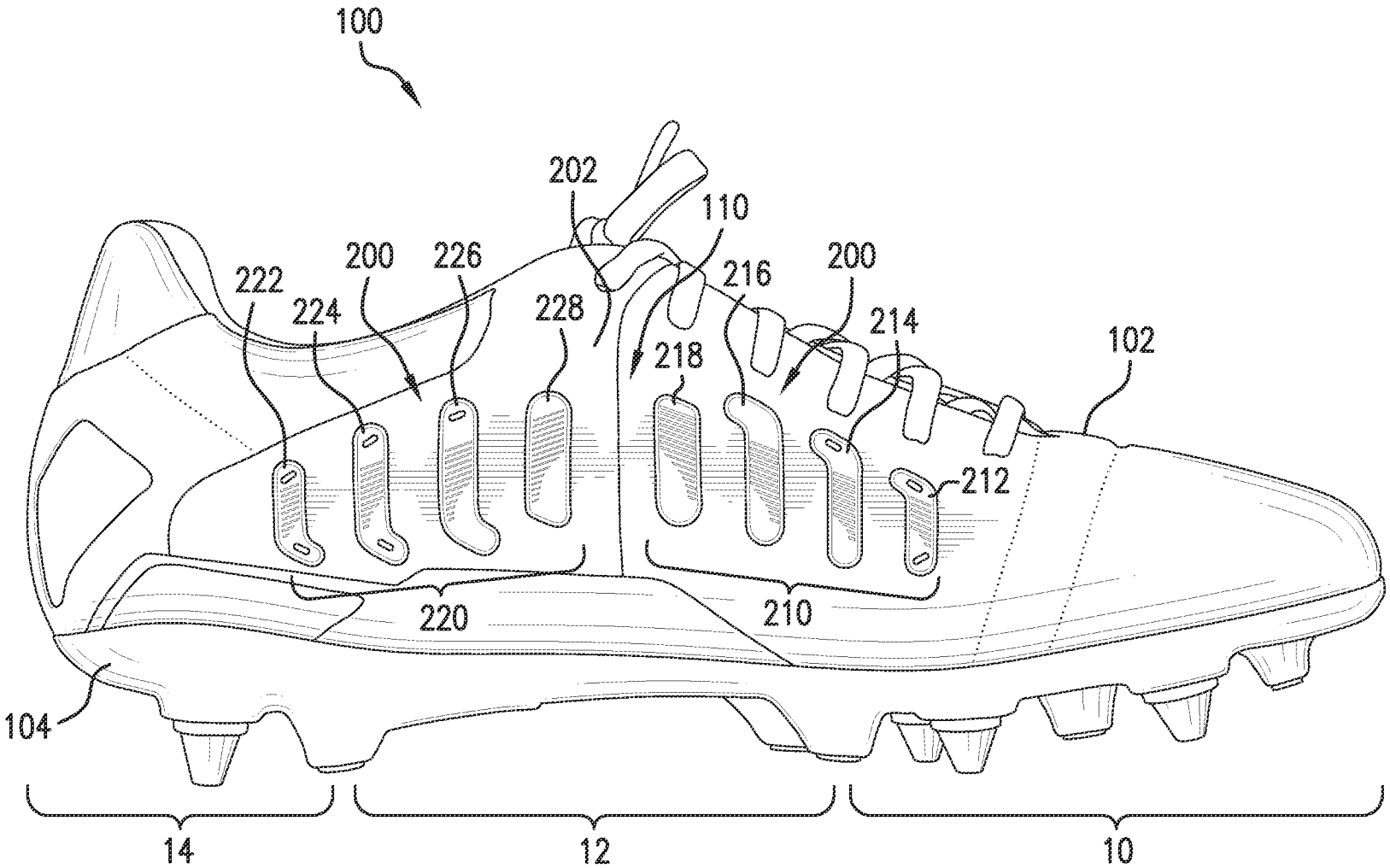
FIG. 2 is a side view of an embodiment of a medial side of an article of footwear including a medial contact portion.

Referring now to FIG. 2, in some embodiments, medial contact portion 110 may be arranged on article 100 in a manner that is configured to correspond to the location and shape of a ball. In an exemplary embodiment, medial contact portion 110 may extend through one or more regions associated with medial side 16 of article 100. In some cases, medial contact portion 110 may extend between forefoot region 10 and heel region 14 in a generally longitudinal direction. In an exemplary embodiment, medial contact portion 110 may be substantially disposed in midfoot region 12 and may extend partially into each of forefoot region 10 and/or heel region 14. With this arrangement, medial contact portion 110 may be disposed on article 100 at a location that corresponds to the placement of a ball when trapping or passing.

In an exemplary embodiment, medial contact portion 110 may include provisions for dampening or cushioning an article during impact with a ball when trapping or passing. In addition, in some embodiments, medial contact portion 110 may include provisions for enhancing traction of portions of an article for purposes of better ball control during trapping or passing.

In some embodiments, medial contact portion 110 may include a plurality of raised elements 200 disposed on upper 102. In some cases, plurality of raised elements 200 may be configured to deform upon impact with a ball to absorb energy and/or to provide increased grip on a ball during passing. In an exemplary embodiment, raised elements 200 may be disposed along medial side 16 of article 100 and may be raised above a surface 202 of upper 102. In one embodiment, plurality of raised elements 200 may be configured with a substantially flat distal surface. With this arrangement, when a ball approaches medial contact portion 110 of article 100, raised elements 200 may contact the ball prior to upper 102, thereby absorbing and dampening the impact of the ball with article 100.

Generally, raised elements 200 may be formed from any suitable material. Examples of materials for making raised elements 200 include, but are not limited to: plastics, elastomers, siloxanes, natural rubber, other synthetic rubbers as well as any other materials.

In some embodiments, plurality of raised elements 200 on medial contact portion 110 may be arranged on article 100 through midfoot region 12 and extending into forefoot region 10 and/or heel region 14. In an exemplary embodiment, plurality of raised elements 200 may be configured into multiple groups of raised elements disposed along surface 202 of upper 102. In one embodiment, plurality of raised elements 200 may include a first group 210 of raised elements associated with a forward portion of article 100 extending from midfoot region 12 into a portion of forefoot region 10 and a second group 220 of raised elements associated with a rearward portion of article 100 extending from midfoot region 12 into a portion of heel region 14.

In this embodiment, first group 210 may include four raised elements, including a first raised element 212, a second raised element 214, a third raised element 216, and a fourth raised element 218. In some cases, first raised element 212 may be disposed in forefoot region 10 of article 100 and each of second raised element 214, third raised element 216, and fourth raised element 218 may be disposed in midfoot region 12 of article 100. In other cases, the raised elements associated with first group 210 may be disposed wholly within midfoot region 12. Similarly, second group 220 may include four raised elements, including a fifth raised element 222, a sixth raised element 224, a seventh raised element 226, and/or an eighth raised element 228. In some cases, fifth raised element 222 may be disposed in heel region 14 of article 100 and each of sixth raised element 224, seventh raised element 226, and eighth raised element 228 may be disposed in midfoot region 12 of article 100. In other cases, the raised elements associated with second group 220 may be disposed wholly within midfoot region 12. In other embodiments, first group 210 and/or second group 220 may include a larger or smaller number of raised elements.

Figure 3:
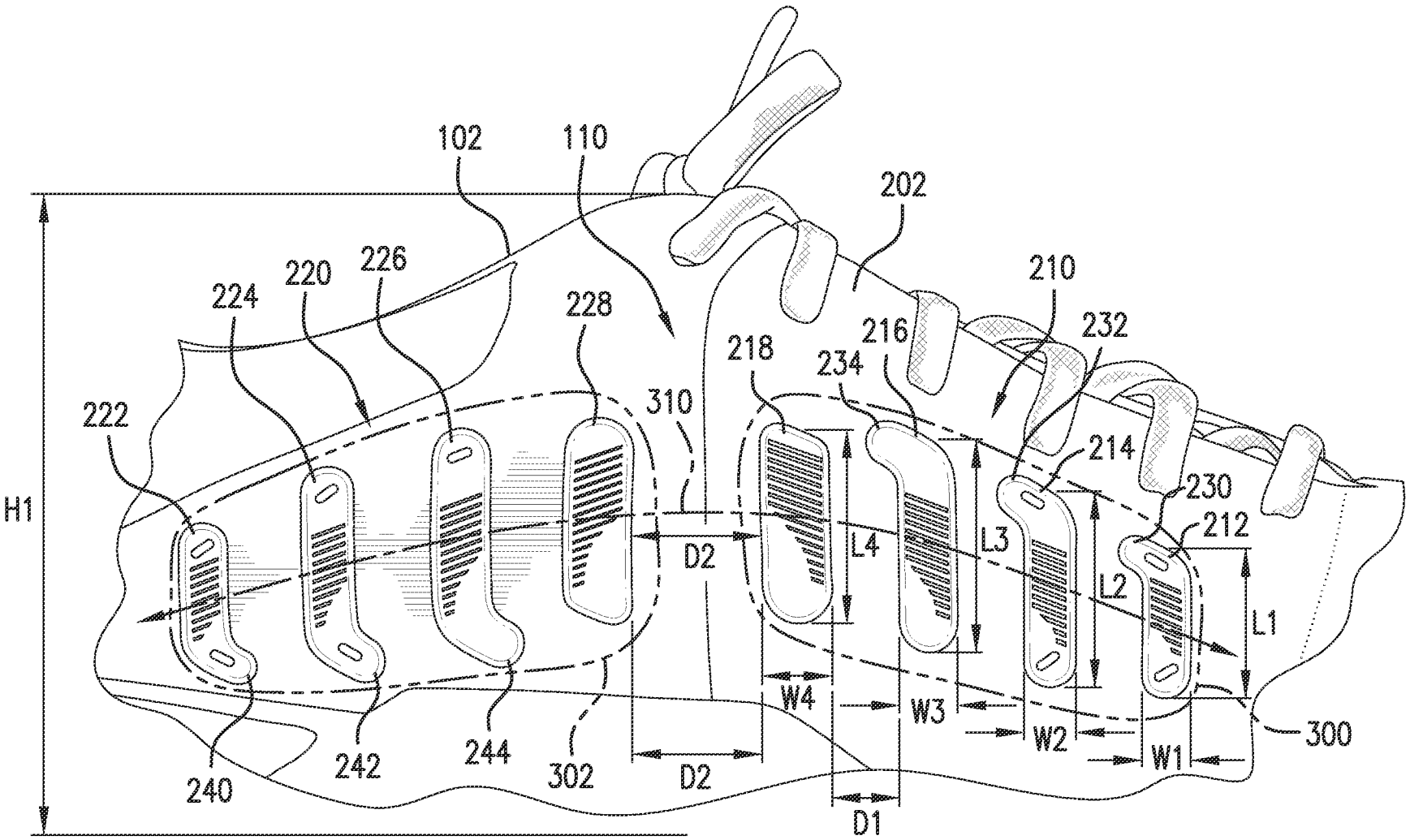
FIG. 3 is an enlarged side view of an embodiment of a medial contact portion on an article of footwear.

Referring now to FIG. 3, an enlarged view of medial contact portion 110 disposed on article 100 is illustrated. In an exemplary embodiment, one or more of the individual raised elements associated with first group 210 and/or second group 220 may vary in size and/or shape from one another. For purposes of characterizing the size, geometry and/or orientation of a raised element, each raised element discussed in this detailed description and in the claims may be associated with a set of axes that are defined relative to each raised element. The term "major axis" as used throughout this detailed description and in the claims refers to an axis extending through a length of a raised element and aligned generally along the lateral axis of article 100. The term "minor axis" as used throughout this detailed description and in the claims refers to an axis extending through a width of a raised element and aligned generally along the longitudinal axis of article 100. Furthermore, the term "normal axis" as used throughout this detailed description and in the claims refers to a direction extending through a height of the raised element from surface 202 of upper 102, which is generally perpendicular (or normal) to a plane formed between the major axis and the minor axis. It should be understood that these axes are defined locally with respect to an individual raised element so that a major axis of one raised element may not be coincident with a major axis of another protrusion.

In this embodiment, first raised element 212 may be associated with a first length L1 along the major axis and a first width W1 along the minor axis. Similarly, second raised element 214 may be associated with a second length L2 and a second width W2 and third raised element 216 may be associated with a third length L3 and a third width W3. Additionally, fourth raised element 218 may be associated with a fourth length L4 and a fourth width W4.

In an exemplary embodiment, the lengths and/or widths of each of the raised elements associated with first group 210 may vary. In this embodiment, first length L1 associated with first raised element 212 may be smaller than one or more of second length L2, third length L3 and/or fourth length L4. In some embodiments, the length of the individual raised elements associated with first group 210 may increase moving from forefoot region 10 towards midfoot region 12. In this embodiment, second length L2 of second raised element 214 is larger than first length L1 and third length L3 of third raised element 216 is larger than second length L2 and first length L1. In some cases, fourth length L4 of fourth raised element 218 may be larger than first length L1 and equal to or smaller than second length L2 and/or third length L3. With this arrangement, the length of the individual raised members may be increased closer to midfoot region 12 of article 100 to provide a greater surface area for contacting a ball.

In some embodiments, the lengths of each of the raised elements associated with the first group 210 may be configured to extend less than a height H1 of upper 102. In an exemplary embodiment, each of first raised element 212, second raised element 214, third raised element 216, and fourth raised element 218 are associated with lengths that are substantially less than height H1 of upper 102. In one embodiment, first length L1, second length L2, third length L3, and/or fourth length L4 are no greater than approximately 45-55% of height H1 of upper 102. In other embodiments, the lengths of the individual raised elements may be a small or larger proportion of the total height H1 of upper 102. With this arrangement, first group 210 of raised elements may be configured to provide sufficient dampening or cushioning of an impact between article 100 and a ball, while providing improved traction and friction from surface 202 of upper 102. In particular, in embodiments where upper 102 is made from a synthetic leather material that is configured to have substantially the same coefficient of friction under dry conditions and wet conditions, traction between article 100 and the ball may be increased in wet conditions by limiting the surface area of first group 210 of raised elements on surface 202 of upper 102.

In addition, in some embodiments, the width of the individual raised elements may vary. In this embodiment, fourth width L4 associated with fourth raised element 218 may be larger than one or more of first width W1, second width W2, and/or third width W3. In one embodiment, first width W1, second width W2, and/or third width W3 may be substantially similar. With this arrangement, fourth raised element 218 may be wider at midfoot region 12 of article 12 to provide a larger surface area to contact a ball. In other words, the larger width of fourth raised element 218 may be configured as a "sweet spot" for contacting a ball at approximately the central portion of midfoot region 12.

In some embodiments, individual raised elements may include additional provisions that are configured to provide additional contact with a ball. As shown in FIG. 3, some raised elements may include extended edges along one end of the raised element. In this embodiment, first raised element 212 may include a first extended edge 230 along a top end of the raised element and extending in a rearward direction towards midfoot region 12. Similarly, second raised element 214 may include a second extended edge 232 and/or third raised element 216 may include a third extended edge 234 along the top of each raised element that extends in a rearward direction. With this arrangement, first extended edge 230, second extended edge 232, and/or third extended edge 234 may be configured to assist with directing the ball upon contact during passing or trapping.

In some embodiments, first group 210 of raised elements and second group 220 of raised elements may be similar groups of raised elements arranged as mirror images of each other across opposite sides of midfoot region 12. In this embodiment, fifth raised element 222 may be substantially similar to first raised element 212 in size and/or shape, including length and width, as discussed above. Similarly, sixth raised element 224 may be substantially similar to second raised element 214, seventh raised element 226 may be substantially similar to third raised element 216, and/or eighth raised element 228 may be substantially similar to fourth raised element 218. In other embodiments, first group 210 of raised elements and second group 220 of raised elements may have different arrangements and may include individual raised elements having various sizes and/or shapes.

In an exemplary embodiment, second group 220 of raised elements may include extended edges similar to the extended edges associated with first group 210 of raised elements above. The extended edges associated with second group 220 of raised elements may be disposed along a bottom end of the individual raised element, instead of along the top end and may extend in a forward direction towards midfoot region 12 of article 100. In this embodiment, fifth raised element 222 may include a fourth extended edge 240 along the bottom of the raised element and extending in a forward direction towards midfoot region 12. Similarly, sixth raised element 224 may include a fifth extended edge 242 and/or seventh raised element 226 may include a sixth extended edge 244 along the bottom of each raised element that extends in a forward direction. With this arrangement, fourth extended edge 240, fifth extended edge 242, and/or sixth extended edge 244 may be configured to assist with directing the ball upon contact during passing or trapping.

In some embodiments, medial contact portion 110 may include features on portions of an article to help enhance friction between article 100 and a ball. In an exemplary embodiment, medial contact portion 110 may include an arrangement of raised elements 200 that are spaced apart such that a ball may be in contact with portions of upper 102 disposed between raised elements 200. As noted above, upper 102 may be made of a synthetic leather material that is configured to have substantially the same coefficient of friction under dry conditions and wet conditions. With this arrangement, the spacing of raised elements 200 may be provided to allow a ball to partially contact upper 102 and help assist with maximizing friction between the ball and article 100 under wet conditions.

In this embodiment, each of the individual raised elements associated with first group 210 and/or second group 220 may be spaced apart by a separation distance D1. In some embodiments, separation distance D1 may be greater than or equal to the width associated with the individual raised elements. For example, in this embodiment, separation distance D1 is greater than first width W1 associated with first raised element 212, as well as second width W2 and/or third width W3. In this embodiment, separation distance D1 may be approximately equal to fourth width W4 associated with fourth raised element 218. With this arrangement, sufficient space may be provided between the individual raised elements of first group 210 to allow a ball to partially contact upper 102. In other embodiments, separation distance D1 may be smaller or larger.

In an exemplary embodiment, first group 210 and second group 220 of raised elements may be spaced apart on upper 102 by a midfoot separation distance D2. In one embodiment, midfoot separation distance D2 may be larger than separation distance D1 between individual raised elements of first group 210 and/or second group 220. In this embodiment, midfoot separation distance D2 is illustrated as the distance between fourth raised element 218 and eighth raised element 228. In an exemplary embodiment, midfoot separation distance D2 may be approximately two times as wide as separation distance D1. With this arrangement, a larger portion of upper 102 may be provided at the middle of midfoot region 12 to contact a ball and help assist with maximizing friction between the ball and article 100 under wet conditions. In other words, the larger width of midfoot separation distance D2 may be configured as a "sweet spot" for contacting a ball at approximately the center of midfoot region 12. In other embodiments, midfoot separation distance D2 between first group 210 and second group 220 of raised elements may be smaller or larger.

In some embodiments, the arrangement of raised elements associated with each of first group 210 and second group 220 may be configured to have a generally elliptical shape. As shown in FIG. 3, first group 210 of raised elements may be arranged with varying heights of raised elements to form a first elliptical shape 300. Similarly, second group 220 of raised elements may be arranged with varying heights of raised elements to form a second elliptical shape 302. In some embodiments, the arrangement of first group 210 and second group 220 of raised elements taken together may be configured to have a generally curved or arc-like shape. As shown in FIG. 3, the centerpoints of raised elements of first group 210 and second group 220 may be disposed along upper 102 in an arc-like configuration 310. The shape of arc-like configuration 310 corresponds generally to a shape and curvature of a ball. In addition, the shape of arc-like configuration 310 may follow the natural contours of a foot of a wearer of article 100. With this arrangement, arc-like configuration 310 may assist medial contact portion 110 to contact and conform to a ball during passing or trapping. In other embodiments, the raised elements associated with first group 210 and second group 220 may be disposed on upper 102 with a different arrangement to provide other shapes for medial contact portion 110.

Figure 4:
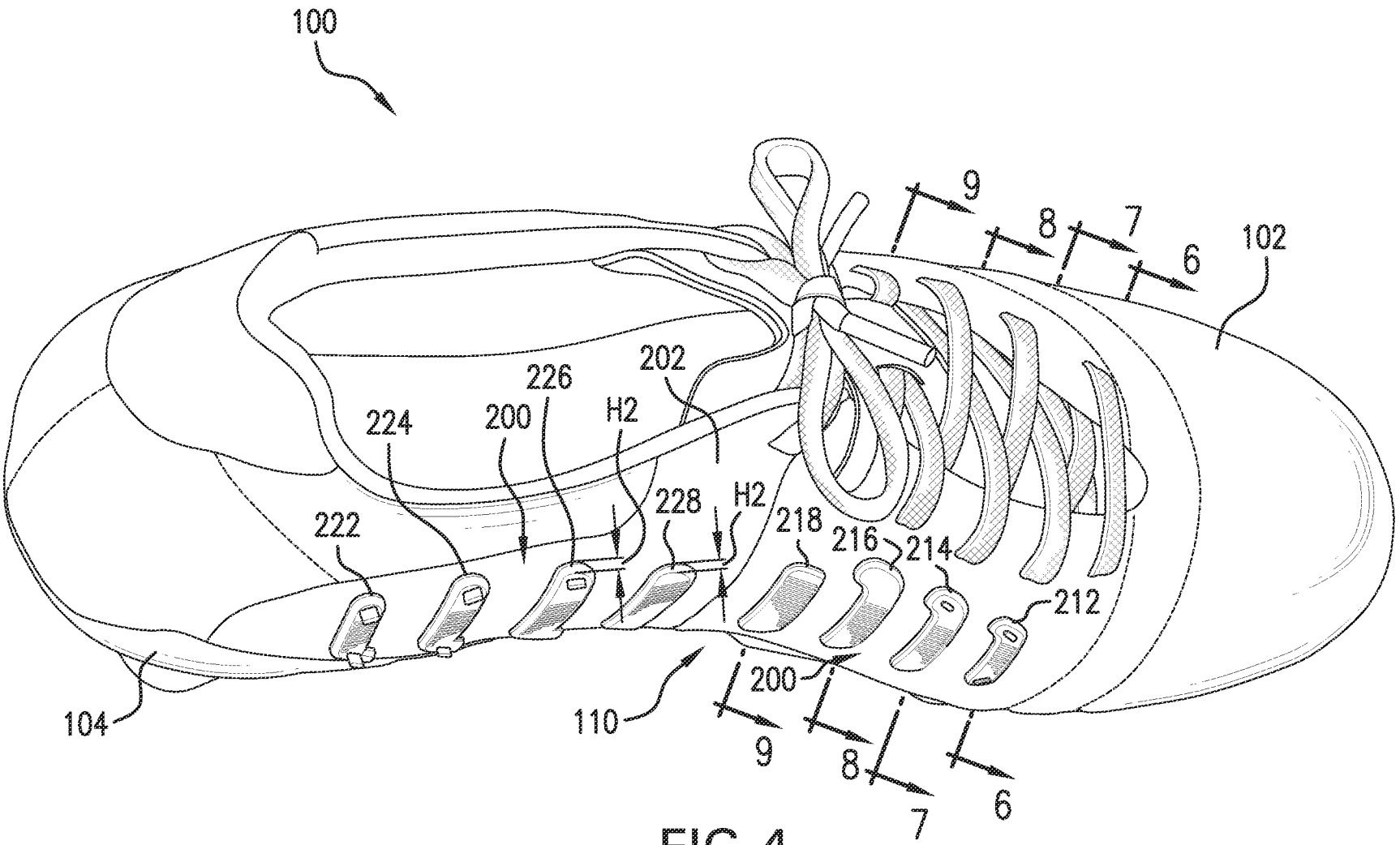
FIG. 4 is a top view of an embodiment of an article of footwear including a medial contact portion.

Referring now to FIG. 4, a top view of an embodiment of an article of footwear 100 including a medial contact portion 110 that includes plurality of raised elements 200 extending outwards from the surface 202 of upper 102 is illustrated. In some embodiments, plurality of raised elements 200 may extend outwards from surface 202 by a second height H2. In an exemplary embodiment, second height H2 may be configured to allow plurality of raised elements 200 to contact a ball before portions of upper 102 disposed between the raised elements contact the ball. In one embodiment, second height H2 may be from 1 mm to 3 mm. In other embodiments, second height H2 may be larger or smaller. With this arrangement, plurality of raised elements may be configured to provide dampening or cushioning of an impact between article 100 and a ball.

Figure 5:
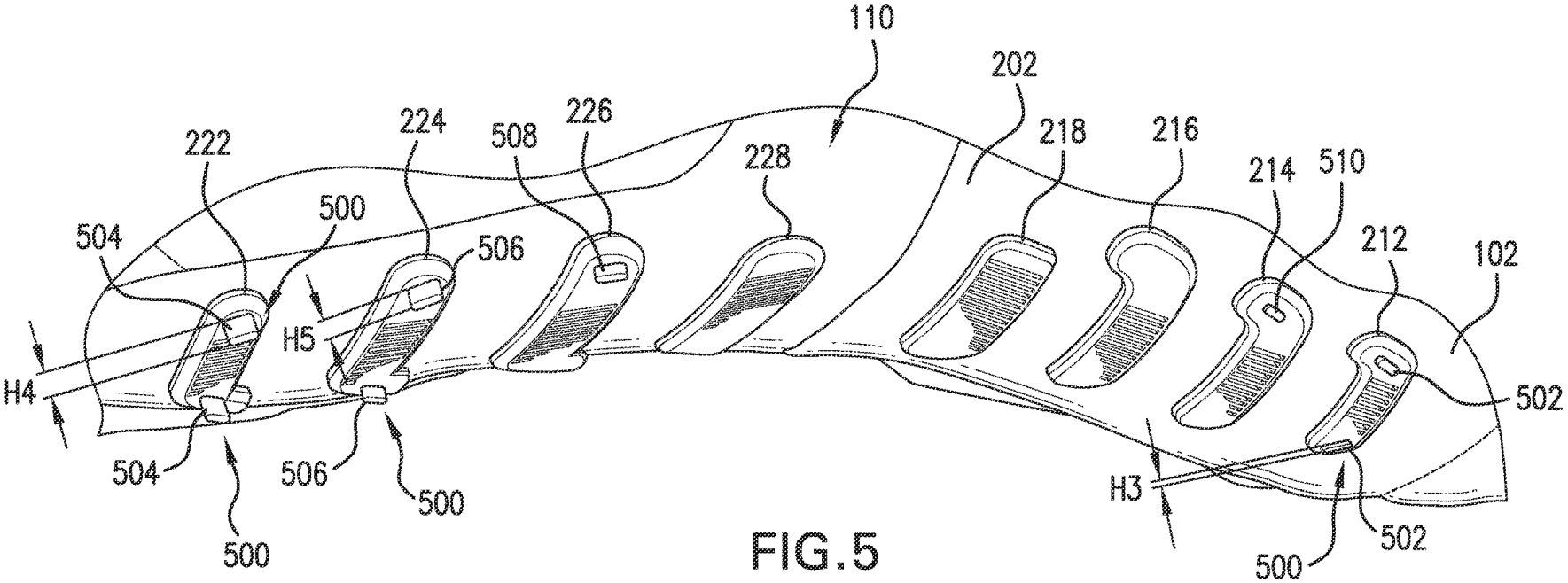
FIG. 5 is an enlarged top view of an embodiment of a medial contact portion on an article of footwear.

In some embodiments, plurality of raised elements may be provided with additional components for contacting a ball. As shown in FIG. 5, in an exemplary embodiment, individual raised elements may be provided with protrusions 500. Generally, protrusions 500 may be any type of projection that extends outwards from the surface of a raised element along the normal axis and approximately perpendicular to surface 202 of upper 102. In different embodiments, protrusions 500 can be configured in various ways. For example, in some cases, protrusions 500 may be characterized as fin-like protrusions. In other cases, protrusions 500 may be characterized as having any geometric or irregular shape. In this embodiment, protrusions 500 may be characterized as fin-like protrusions.

Referring again to FIG. 5, in some embodiments, protrusions 500 may be disposed on one or more of the individual raised elements associated with medial contact portion 110. In an exemplary embodiment, protrusions 500 may be angled along a desired direction to assist with directing a ball during passing or trapping. In this embodiment, a first pair of protrusions 502 may be provided near the top and bottom ends of first raised element 212. First pair of protrusions 502 may be associated with a third height H3 from the surface of first raised element 212. Similarly, a second pair of protrusions 504 associated with a fourth height H4 may be provided near the top and bottom ends of fifth raised element 222 and a third pair of protrusions 506 associated with a fifth height H5 may be provided near the top and bottom ends of sixth raised element 224. In this embodiment, fourth height H4 and/or fifth height H5 may be larger than third height H3. In some cases, fourth height H4 may be larger than fifth height H5. In other cases, third height H3, fourth height H4, and/or fifth height H5 may be smaller or larger.

In addition, in some embodiments, one or more raised elements may include a protrusion at only one end. In this embodiment, seventh raised element 226 includes a protrusion 508 disposed at the top of the raised element. Protrusion 508 may be associated with a sixth height H6 that is configured to be smaller than third height H3, fourth height H4, and/or fifth height H5. Similarly, second raised element 214 may include a protrusion 510 disposed at the top of the raised element.

In some embodiments, the heights of the protrusions on the raised elements may vary in proportion to the distance from the center of midfoot region 12. For example, in this embodiment, the height of second pair of protrusions 504 disposed on fifth raised element 222, third pair of protrusions 506 disposed on sixth raised element 224, and/or protrusion 508 disposed on seventh raised element 226 may arranged from largest to smallest such that fourth height H4 is larger than fifth height H5 and sixth height H6, and fifth height H5 is larger than sixth height H6. In an exemplary embodiment, fourth height H4 may be from 3 mm to 6 mm, fifth height H5 may be from 2 mm to 4 mm, and sixth height H6 may be from 0.5 mm to 1.5 mm. In other embodiments, the heights may be smaller or larger. With this arrangement, protrusions 500 disposed on the raised elements of second group 220 may be configured to assist with directing a ball during passing or trapping. In some embodiments, protrusions disposed on the individual raised elements associated with first group 210 may have a similar configuration.

In addition, in an exemplary embodiment, one or more of the raised elements associated with the central portion of midfoot region 12 of medial contact portion 110 may be substantially free of protrusions. As shown in FIG. 5, one or more of third raised element 216 and fourth raised element 218 associated with first group 210 of raised elements and eighth raised element 228 associated with second group 220 may be substantially free of protrusions. With this arrangement, the central portion of midfoot region 12 may be configured to have a surface substantially free of any additional protrusions that may contact a ball, thereby providing a substantially flat distal surface as a "sweet spot" for contacting the ball.

FIGS. 6 through 9 illustrate cross-sectional views taken at various portions of article 100 coinciding with different raised elements of medial contact portion 110. In some embodiments, raised elements 200 are configured to be disposed on medial side 16 of upper 102 at the widest lateral portion or girth of article 100. With this arrangement, raised elements 200 may extend out from surface 202 of upper 102 to contact a ball prior to any other portion of upper 102. In some embodiments, raised elements 200 may further be configured to be disposed at various vertical distances on medial side of upper 102 to follow the contour and shape of the widest lateral portion or girth of article 100. In an exemplary embodiment, the variation in the vertical distances of each individual raised element associated with medial contact portion 110 may be configured such that the ends of the raised elements associated with first group 210 follow first elliptical shape 300 and the ends of the raised elements associated with second group 220 follow second elliptical shape 302, discussed above. Moreover, in some embodiments, the centerpoints of raised elements 200 may be configured to follow arc-like configuration 310, discussed above.

Figure 6:
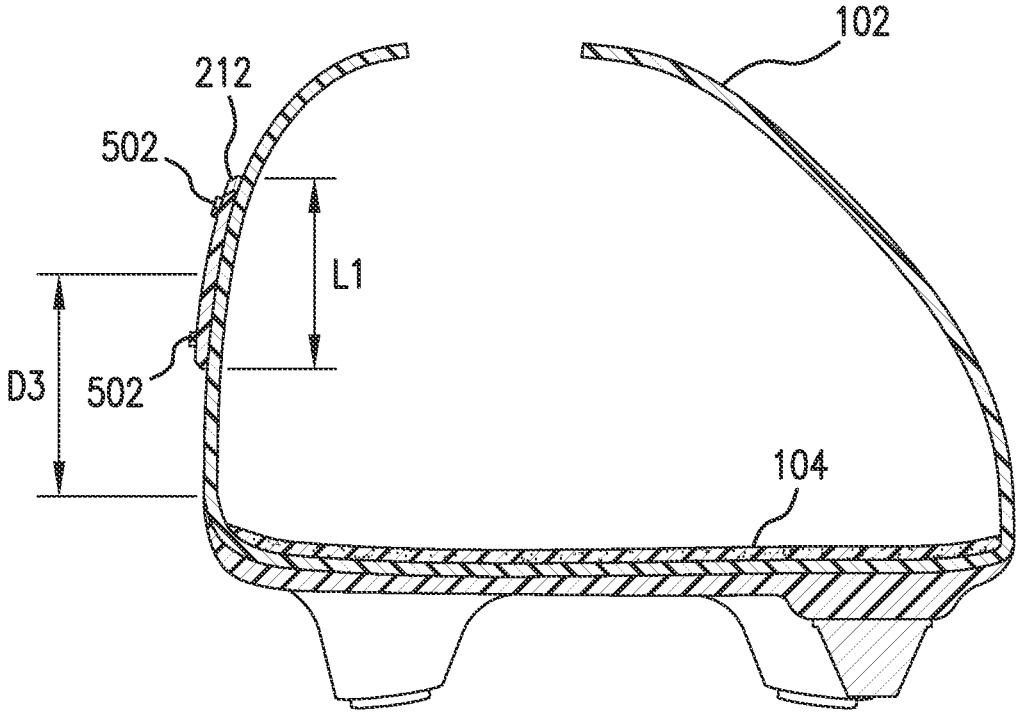
FIG. 6 is a cross-sectional view of an embodiment of an article of footwear including a medial contact portion at a first location.

Referring now to FIG. 6, a lateral cross-section view of article 100 taken along a line through first raised element 212 is illustrated. In this embodiment, first raised element 212 is disposed on upper 102 at a location coinciding with the widest lateral portion of article 100. In addition, the centerpoint of first raised element 212 is disposed on upper 102 at a vertical distance D3 from the bottom of upper 102.

Figure 7:
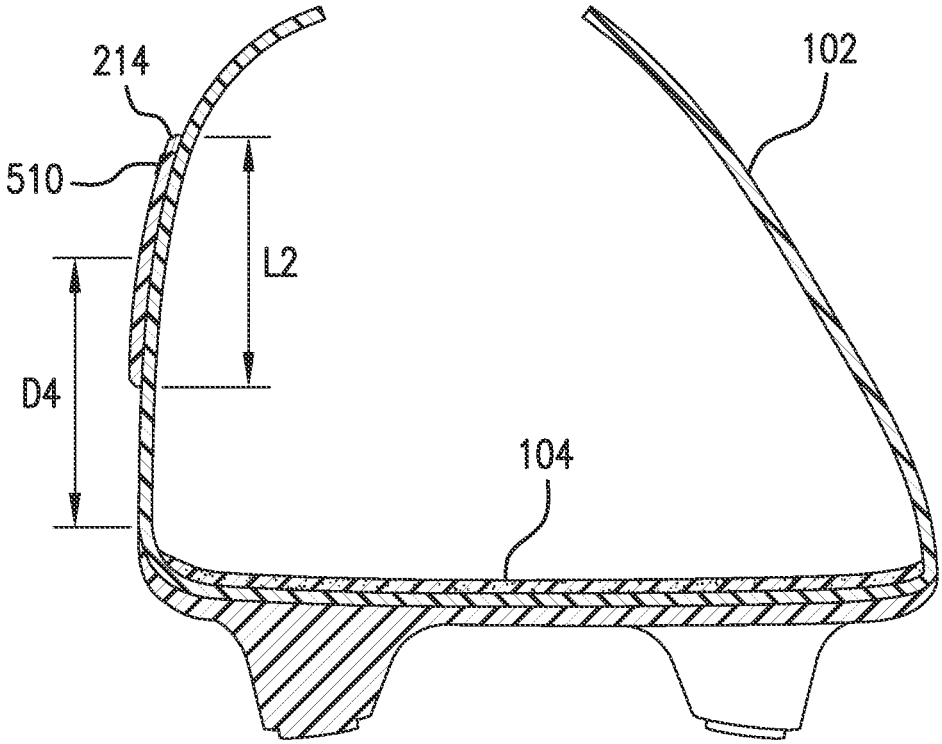
FIG. 7 is a cross-sectional view of an embodiment of an article of footwear including a medial contact portion at a second location.

FIG. 7 illustrates a lateral cross-section view of article 100 taken along a line through second raised element 214. In this embodiment, second raised element 214 is disposed on upper 102 at a location coinciding with the widest lateral portion of article 100. In addition, the centerpoint of second raised element 214 is disposed on upper 102 at a vertical distance D4 from the bottom of upper 102. In an exemplary embodiment, vertical distance D4 associated with second raised element 214 may be larger than vertical distance D3 associated with first raised element 212.

Figure 8:
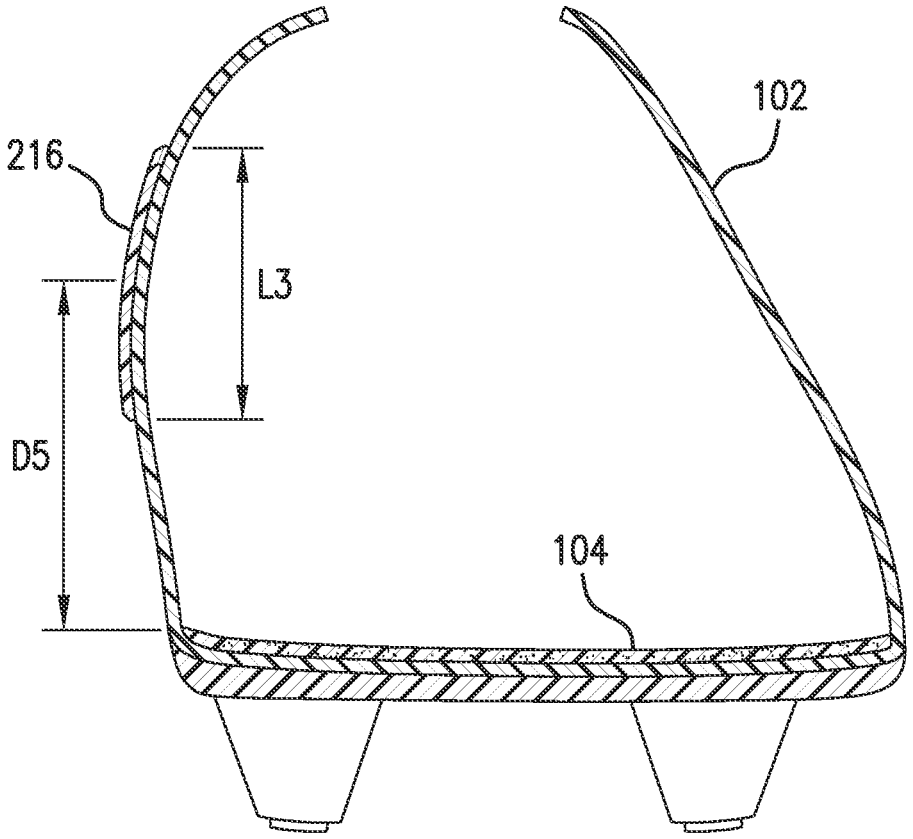
FIG. 8 is a cross-sectional view of an embodiment of an article of footwear including a medial contact portion at a third location.

Referring now to FIG. 8, a lateral cross-section view of article 100 taken along a line through third raised element 216 is illustrated. In this embodiment, third raised element 216 is disposed on upper 102 at a location coinciding with the widest lateral portion of article 100. In some cases, the widest lateral portion of article 100 may not be the same at every cross-sectional portion of article 100. For example, in one embodiment, the widest lateral portion of article 100 illustrated in FIG. 8 may be wider and extend outward towards medial side 16 a larger amount than the widest lateral portion of article illustrated in any of FIG. 6 and FIG. 7 above. Such a configuration follows the contours of article 100 along medial side 16 to account for the shape of a foot of a wearer. In addition, the centerpoint of third raised element 216 is disposed on upper 102 at a vertical distance D5 from the bottom of upper 102. In an exemplary embodiment, vertical distance D5 associated with third raised element 216 may be larger than either vertical distance D4 associated with second raised element 214 and/or vertical distance D3 associated with first raised element 212.

Figure 9:
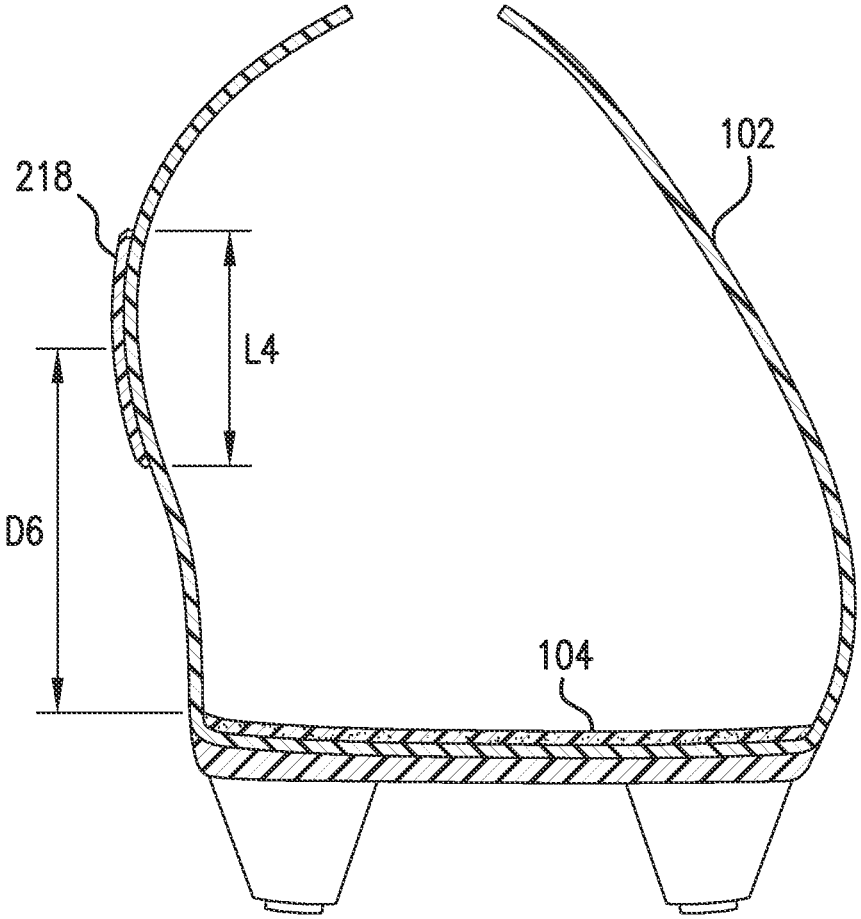
FIG. 9 is a cross-sectional view of an embodiment of an article of footwear including a medial contact portion at a fourth location.

FIG. 9 illustrates a lateral cross-section view of article 100 taken along a line through fourth raised element 218. In this embodiment, fourth raised element 218 is disposed on upper 102 at a location coinciding with the widest lateral portion of article 100. In addition, the centerpoint of fourth raised element 218 is disposed on upper 102 at a vertical distance D6 from the bottom of upper 102. In an exemplary embodiment, vertical distance D6 associated with fourth raised element 218 may be smaller than vertical distance D5 associated with third raised element 216 and may be larger than vertical distance D4 associated with second raised element 214 and/or vertical distance D3 associated with first raised element 212. With this arrangement, the vertical displacement of each of first raised element 212, second raised element 214, third raised element 216, and fourth raised element 218 may correspond to follow first elliptical shape 300.

It should be understood that the location of each raised element associated with first group 210 of raised elements illustrated in FIGS. 6 through 9 may be similarly arranged as a mirror image in second group 220 of raised elements across opposite sides of midfoot region 12. With this arrangement, plurality of raised elements 200 associated with medial contact portion 110 may be arranged in arc-like configuration 310, discussed above. In other embodiments, the location of individual raised elements may be varied to form different configurations.

Figure 10:
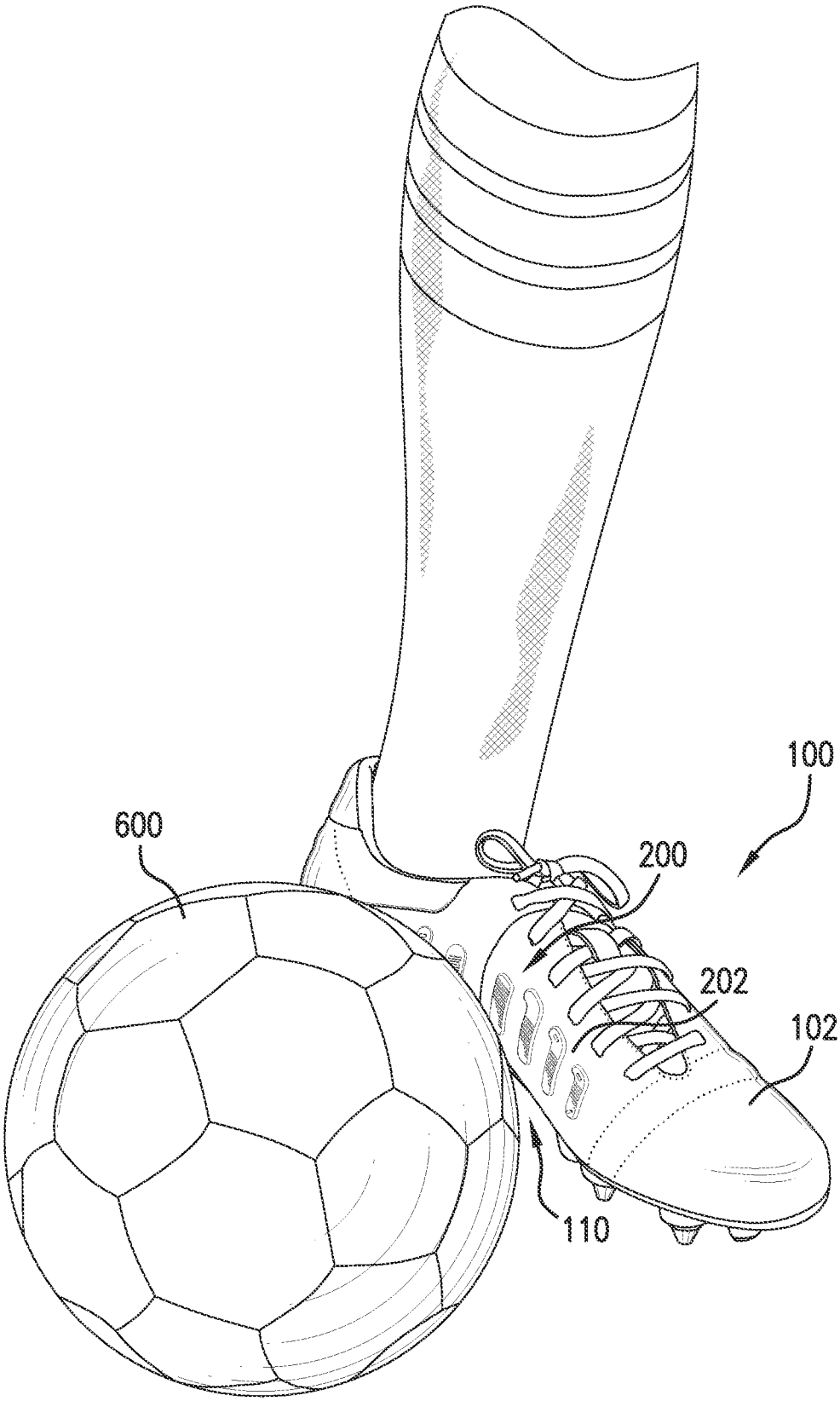
FIG. 10 is a representative view of a ball being kicked using an embodiment of an article of footwear having a medial control portion.

Referring now to FIG. 10, a representative view of a ball 600 being kicked using an embodiment of article of footwear 100 having medial control portion 110 is illustrated. In an exemplary embodiment, ball 600 may contact medial control portion 110 of article 100 along medial side 16 of upper 102. As described above, one or more of plurality of raised elements 200 of first group 210 and/or second group 220 associated with medial contact portion 110 may contact ball 600 during passing or trapping of ball 600 with article 100. In addition, in some embodiments, the arrangement and/or spacing of plurality of raised elements 200 may be configured such that a portion of upper 102 disposed between plurality of raised elements 200 may contact ball 600 at medial contact portion 110.

In an exemplary embodiment, when ball 600 approaches medial contact portion 110 and initially contacts article 100, plurality of raised elements 200 extending out from surface 202 of upper 102 may first contact ball 600. With this arrangement, plurality of raised elements 200 may provide dampening or cushioning of the impact between article 100 and ball 600. In one embodiment, the portion of upper 102 that is exposed between plurality of raised elements 200 may also contact ball 600 after initial contact with plurality of raised elements 200. As discussed above, in some embodiments, upper 102 may be made of a synthetic leather material that is configured to have substantially the same coefficient of friction under dry conditions and wet conditions. With this arrangement, the space between plurality of raised elements 200 may be provided to allow ball 600 to partially contact upper 102 and help assist with maximizing friction between ball 600 and article 100 under wet conditions.

Figure 11:
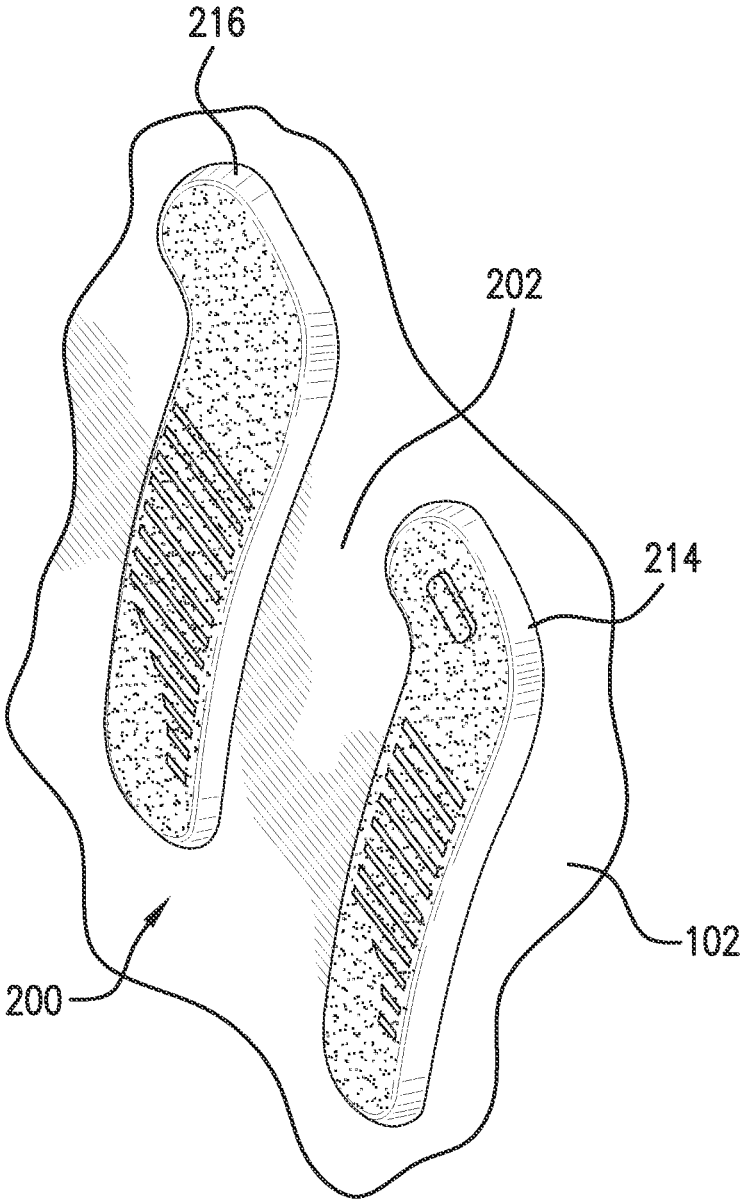
FIG. 11 is a schematic view of an embodiment of a medial contact portion including a plurality of contact elements during contact with a ball.

Referring now to FIG. 11, an interior view illustrating the contact patch between ball 600 and medial contact portion 110 from inside ball 600 is illustrated. As shown in FIG. 11, ball 600 makes initial contact with plurality of raised elements 200, including second raised element 214 and/or third raised element 216. In some embodiments, ball 600 may make contact with the top surface of second raised element 214 and/or third raised element 216. In addition, in embodiments where a raised element includes one or more protrusions, such as protrusion 510, ball 600 may also make contact with the protrusion. It should be understood that while two raised elements are shown in contact with ball 600, in various embodiments, any number of raised elements 200 may be in contact with ball 600 when impacted by medial contact portion 110 of article 100. With this arrangement, plurality of raised elements 200 associated with medial contact portion 110 may absorb and dampen the forces associated with impacting ball 600 during passing or trapping to provide cushioning to a foot of a wearer and to provide friction to assist with directing and spinning ball 600.

In some embodiments, ball 600 may additionally make contact with a portion of surface 202 of upper 102 that is disposed between the spaced apart individual raised elements 200. As noted above, in some embodiments, upper 102 may be made of a synthetic leather material that is configured to have substantially the same coefficient of friction under dry conditions and wet conditions. With this arrangement, the portion of upper 102 disposed between raised elements 200 may be provided to allow a ball to partially contact upper 102 and help assist with maximizing friction between the ball and article 100 under wet conditions.

Figure 12:
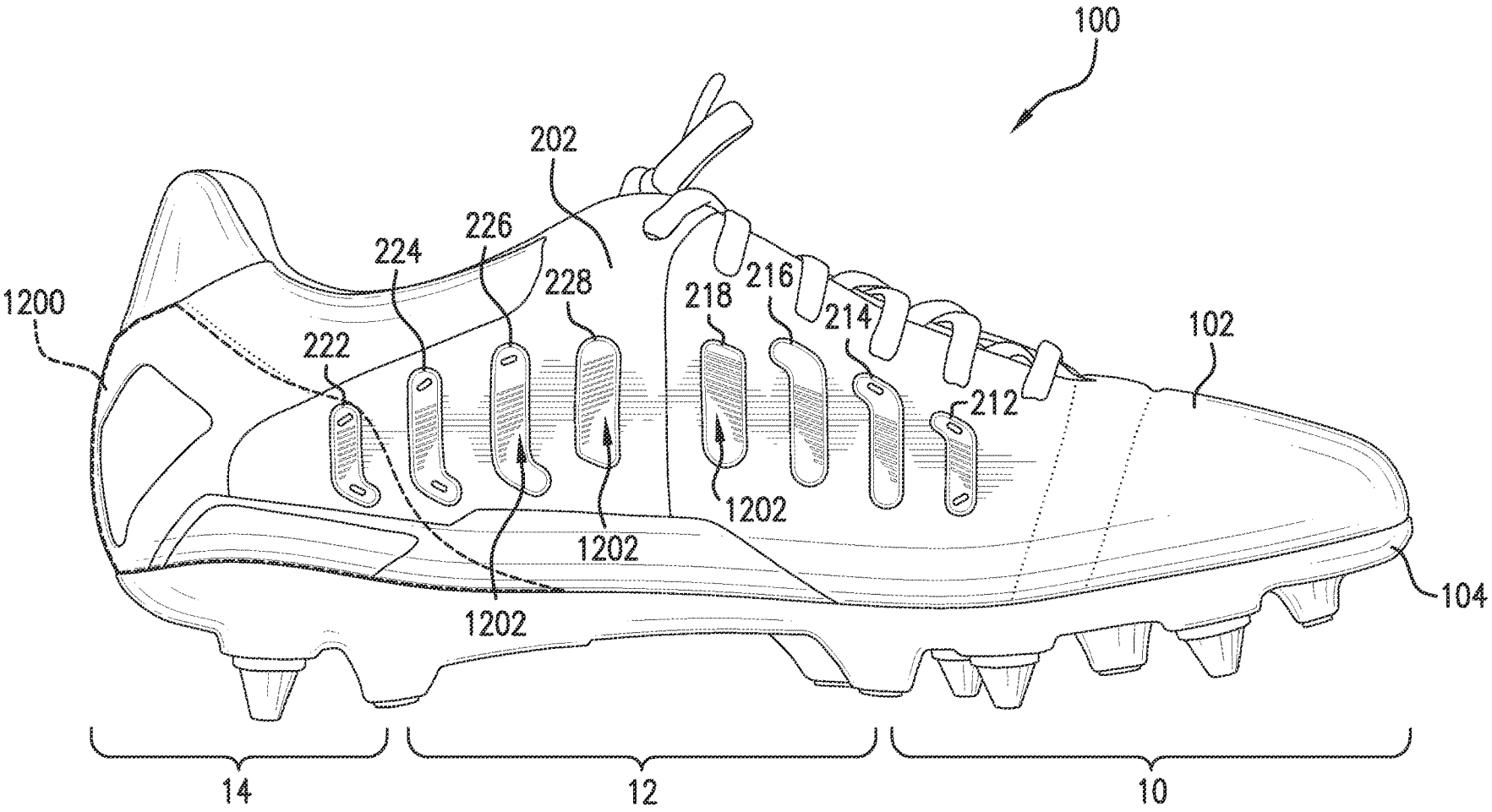
FIG. 12 is a schematic view of an embodiment of a medial contact portion disposed on an upper of an article of footwear.

In some embodiments, provisions on article 100 may be configured to provide added rigidity and structure in some portions of article 100 and added flexibility in other portions of article 100. Referring now to FIG. 12, in some embodiments, sole structure 104 may optionally include a heel cup 1200. In an exemplary embodiment, heel cup 1200 may be made of a rigid material to firmly support the heel of a foot of a wearer. In one embodiment, portions of one or more raised elements may be disposed on upper 102 at locations corresponding to heel cup 1200.

As shown in FIG. 12, in this embodiment, fifth raised element 222 may be disposed on upper 102 at a location that corresponds to heel cup 1200. The rigidity of heel cup 1200 beneath upper 102 at heel region 14 provides a stiff support structure for fifth raised element 222. With this arrangement, fifth raised element 222 may be provided with additional rigidity and stiffness to resist bending. For example, when medial contact portion 110 impacts a ball, one or more raised elements 200 may be configured to absorb and dampen the impact by deforming upon contact, however, by providing heel cup 1200 as a rigid support structure for fifth raised element 222, fifth raised element 222 may remain substantially rigid during impact.

In some embodiments, one or more raised elements associated with medial contact portion 110 may be provided with components that are configured to increase flexibility. For example, in some embodiments, one or more raised elements may include fins 1202. Fins 1202 may be small horizontal ridges in the surface of the raised element that are configured to allow raised elements 200 to increase flexibility and bending. In some embodiments, fins 1202 may also be configured to increase traction between a ball and raised elements 200.

Figure 13:
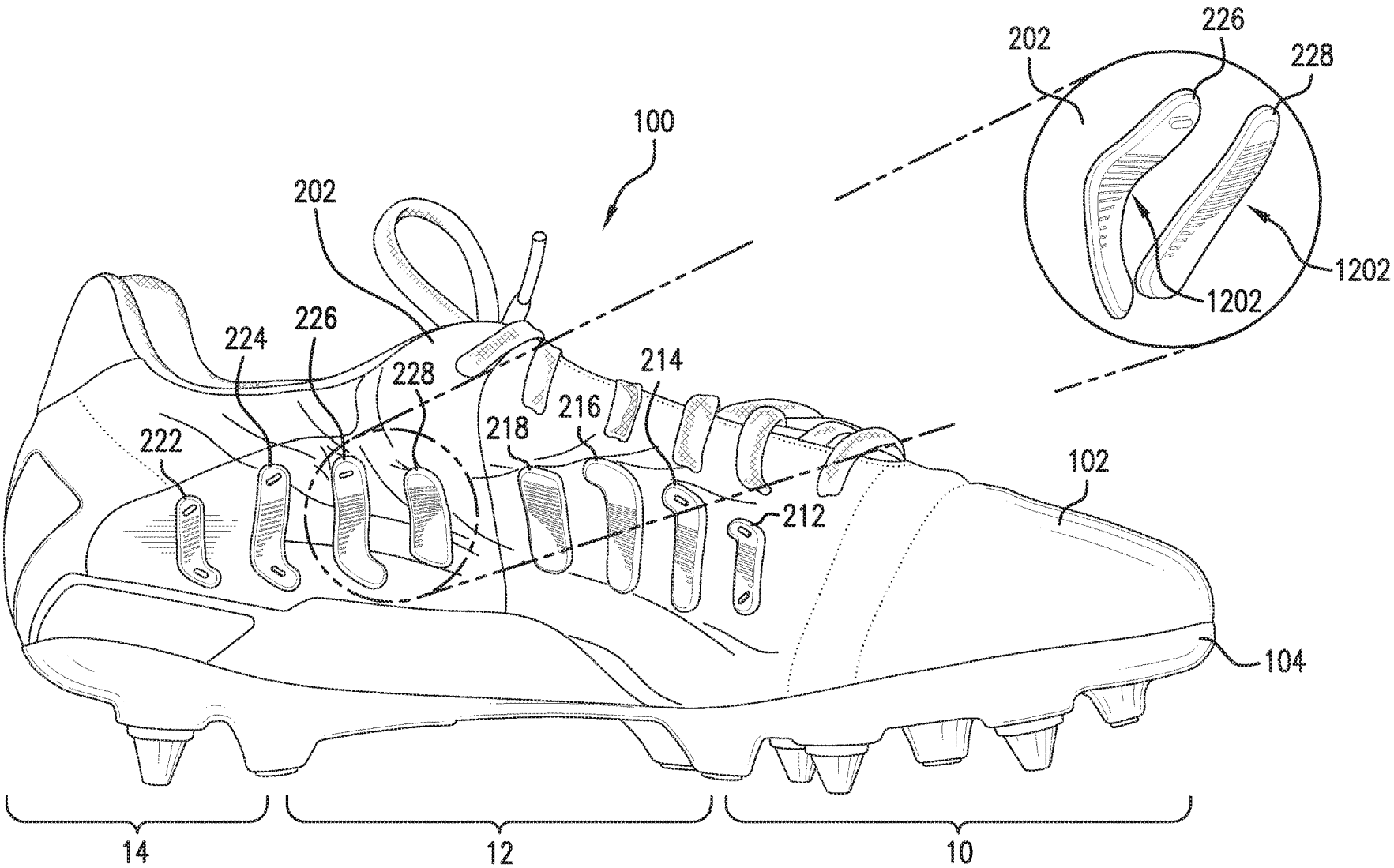
FIG. 13 is a schematic view of an embodiment of a medial contact portion disposed on a flexible portion of an upper of an article of footwear.

Referring now to FIG. 13, an exemplary embodiment illustrating the rigidity and stiffness provided to fifth raised element 222 by heel cup 1200 and the flexibility and ability to bend provided to other raised elements by fins 1202 is illustrated. As shown in FIG. 13, upper 102 of article 100 may be configured to bend and flex along midfoot region 12 and/or forefoot region 10 by providing one or more raised elements 200 with fins 1202. As shown in the enlarged view, fins 1202 disposed on seventh raised element 226 and/or eighth raised element 228 may be configured to allow seventh raised element 226 and/or eighth raised element 228 to bend and flex along with upper 102. In contrast, fifth raised element 222 disposed on heel region 14 of upper 102 at a location corresponding to rigid heel cup 1200 resists bending and remains substantially rigid when upper 102 of article 100 is bent. With this arrangement, medial contact portion 110 may be provided on article 102 that is flexible and lightweight, yet provides effective dampening and cushioning to article 100 during impact with a ball.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

a sole structure;

an upper attached to the sole structure and including a medial side and a lateral side, the upper defining a longitudinal axis and the upper including one or more fastening elements; and a contact portion including a plurality of raised elements disposed on a same one of the medial side or the lateral side, each raised element in the plurality of raised elements extending outwardly from an outermost surface of the upper and terminating at a respective distal surface, wherein (i) the contact portion extends along the longitudinal axis, (ii) a first raised element of the plurality of raised elements of the contact portion includes a first protrusion extending outwardly from the distal surface of the first raised element at one of a first end and a second end of the first raised element, and (iii) the first protrusion is spaced from a perimeter of the first raised element, wherein the plurality of raised elements are positioned posteriorly with respect to an anterior-most extent of the one or more fastening elements.

2. The article of footwear of claim 1, wherein the first raised element includes a second protrusion extending outwardly from the distal surface of the first raised element at the other of the first end and the second end.

3. The article of footwear of claim 2, wherein the plurality of raised elements comprises a second raised element and the second raised element includes a third protrusion extending from the distal surface of the second raised element at one of a first end and a second end of the second raised element.

4. The article of footwear of claim 3, wherein the third protrusion has a different height than the first protrusion.

5. The article of footwear of claim 3, wherein the second raised element includes a fourth protrusion extending from the distal surface of the second raised element at the other of the first end and the second end of the second raised element.

6. The article of footwear of claim 3, wherein the plurality of raised elements comprises a third raised element free from protrusions.

7. The article of footwear of claim 6, wherein the third raised element is disposed closer to a midfoot region of the article of footwear than the second raised element, and the second raised element is disposed closer to the midfoot region than the first raised element.

8. The article of footwear of claim 1, wherein a first height, as measured outward from a surface of the first raised element, of the first protrusion is greater than a thickness of the first raised element.

9. The article of footwear of claim 1, wherein the first raised element includes a branched portion that extends from one of the first end and the second end at an angle to the longitudinal axis and towards a midfoot region of the article of footwear.

10. An article of footwear comprising:

a sole structure defining a ground contactable surface;

an upper attached to the sole structure and defining an opening opposite the sole structure; and a plurality of raised elements each extending from an outer surface of the upper and terminating at a respective distal surface, each of the raised elements having a first end and a second end and respectively extending along a lengthwise axis extending from the first end to the second end, wherein each respective first end is positioned closer to the sole structure than the each respective second end, the plurality of raised elements comprising a first group of raised elements including:

a first raised element having a first protrusion (i) extending outwardly from one of the first end and the second end of the distal surface of the first raised element and (ii) spaced from a perimeter of the first raised element;

a second raised element disposed between a midfoot region of the article of footwear and the first raised element and including a second protrusion extending from one of the first end and the second end of the distal surface of the second raised element; and a third raised element disposed between the midfoot region and the second raised element, the third raised element being free from protrusions.

11. The article of footwear of claim 10, wherein a first height of the first protrusion is greater than a second height of the second protrusion.

12. The article of footwear of claim 10, wherein the first protrusion is positioned along a first protrusion axis, the first protrusion axis being aligned with a second protrusion axis along which the second protrusion is positioned.

13. The article of footwear of claim 12, wherein the first protrusion axis of the first protrusion diverges from the second protrusion axis of the second protrusion along a direction from a forefoot region to the midfoot region.

14. The article of footwear of claim 10, wherein the plurality of raised elements further comprises a second group of raised elements including:

a fourth raised element having a third protrusion extending outwardly from one of the first end and the second end of the distal surface of the fourth raised element;

a fifth raised element disposed between the midfoot region and the fourth raised element and including a fourth protrusion extending from one of the first end and the second end of the distal surface of the fifth raised element; and a sixth raised element disposed between the midfoot region and the fifth raised element, the sixth raised element being free from protrusions.

15. The article of footwear of claim 14, wherein the first group of raised elements is disposed in a forefoot region of the upper and the second group of raised elements is disposed in a heel region of the upper.

16. The article of footwear of claim 10, wherein the first raised element includes a third protrusion extending outwardly from the other of the first end and the second end of the distal surface of the first raised element and the second raised element includes a fourth protrusion extending from the other of the first end and the second end of the distal surface of the second raised element.

17. The article of footwear of claim 16, wherein a first protrusion axis of the first protrusion is transverse to a second protrusion axis of the third protrusion.

18. The article of footwear of claim 10, wherein the first group of raised elements further includes a fourth raised element disposed between the second raised element and the third raised element, the fourth raised element including a third protrusion extending from one of the first end and the second end of the distal surface of the fourth raised element.

19. The article of footwear of claim 18, wherein a first height of the first protrusion is greater than a second height of the second protrusion and the second height of the second protrusion is greater than a third height of the third protrusion.

20. An article of footwear comprising:

a sole structure;

an upper attached to the sole structure and including a medial side and a lateral side, the upper defining a longitudinal axis; and a contact portion including a plurality of raised elements disposed on a same one of the medial side or the lateral side, each raised element in the plurality of raised elements extending outwardly from an outermost surface of the upper and terminating at a respective distal surface, wherein (i) the contact portion extends along the longitudinal axis, (ii) a first raised element of the plurality of raised elements of the contact portion includes a first protrusion extending outwardly from the distal surface of the first raised element at one of a first end and a second end of the first raised element, and (iii) the first protrusion is spaced from a perimeter of the first raised element, each raised element having a length aligned along a vertical direction transverse to the longitudinal axis of the upper and a width extending transverse to the length, wherein for each raised element, the length is greater than the width.

* * * * *